US005458079A

United States Patent [19]

Matthews et al.

[11] Patent Number: 5,458,079

[45] Date of Patent: Oct. 17, 1995

[54] PORTABLE BLIND

[75] Inventors: Thomas B. J. Matthews; M. Tate Wood; Allen H. Hughes, Jr., all of Memphis, Tenn.

[73] Assignee: Avery Outdoors, Inc., Memphis, Tenn.

[21] Appl. No.: 367,450

[22] Filed: Dec. 29, 1994

[51] Int. Cl.[6] ..... B63B 35/86

[52] U.S. Cl. ..... 114/351; 114/361; 135/901

[58] Field of Search ..... 114/351, 361; 135/901

[56] References Cited

U.S. PATENT DOCUMENTS

| | | | |
|---|---|---|---|
| 2,889,839 | 6/1959 | Sheridan, Jr. | 114/361 |
| 3,898,947 | 8/1975 | Moore | 114/361 |
| 4,070,722 | 1/1978 | Sutherland | 135/901 |
| 4,671,203 | 1/1987 | Sanburg | 114/361 |
| 4,716,919 | 1/1988 | Griffin | 135/901 |
| 4,979,456 | 12/1990 | Steward | 135/901 |

*Primary Examiner*—Jesus D. Sotelo

*Attorney, Agent, or Firm*—Baker, Donelson, Bearman & Caldwell

[57] ABSTRACT

A collapsible duck blind for attachment to a boat, being fully adjustable for both width and length to accommodate most conventional boats. In a preferred embodiment, the blinds include four hinged support legs, each having a foot securable to a surface of the boat and an upper end attached to a frame having a pair of movable support structures on either side thereof. A cover is provided for concealing the duck blind and the hunter(s) positioned in the boat, a portion of the blind being movable with the support structures between call and shoot positions. With both support structures lowered to their shoot positions, the hunters' unobstructed range of shooting is a full 360°. With both support structures raised, the hunter is adequately concealed but can still visibly track ducks or other water fowl through a central gap in the blind.

12 Claims, 5 Drawing Sheets

PORTABLE BLIND

BACKGROUND OF THE INVENTION

1. Field

The present invention relates to blinds used for hunting waterfowl and, more particularly, to a portable, boat-supported duck blind that is collapsible and adjustable to fit most conventional boats.

2. Description of the Prior Art

During the past few years, portable blinds have become increasingly popular to waterfowl hunters, primarily, duck hunters, due to their convenience and versatility over stationery blinds. Many duck hunters who typically use stationery blinds also own small, flat bottomed boats for transportation to and from a stationery blind located in a flooded field or lake. Accordingly, numerous attempts have been made to develop a portable duck blind that may be attached to a conventional boat owned by a hunter, or with which a hunter would likely be familiar. One such effort is shown in U.S. Pat. No. 4,979,456 issued Dec. 25, 1990 to Steward.

Additional examples of boat-supported duck blinds are shown in the following U.S. Pat. Nos.: 4,671,203 to Sanburg; 4,593,641 to Adams et al.; 3,787,912 to Huey, Jr.; 4,070,722 to Sutherland; 2,889,839 to Sheridan; 4,106,145 to Gillen et al.; and 2,816,297 to Stanley.

Several desirable features of a portable duck blind are adaptability for different sized boats, ease of attachment to a boat, ease of operation, collapsibility to a lowered position for storage and transportation, and the ability to allow a hunter to shoot in any direction. The aforementioned prior art devices typically do not provide one or more of these desirable features. Some perform acceptably well once installed, but must be custom built for the particular boat with which they will be used. Others are more adaptable for different sized boats, but are unnecessarily complicated to install or cumbersome to use. Still others are relatively simple, but unacceptably restrict a hunter's ability to shoot in any direction. Accordingly, a need has been recognized for an improved portable duck blind which solves these deficiencies in the prior art.

BRIEF SUMMARY OF THE INVENTION

It is an object of the present invention to provide a portable duck blind which remedies the aforementioned deficiencies in the known prior art.

In particular, it is an object of this invention to provide a boat-supported duck blind adjustable for both length and width, to accommodate most conventional boats commonly used by duck hunters.

It is another object of this invention to provide a portable duck blind which is easily lowered for storing and transportation, and easily raised for use in hunting.

It is a further object of this invention to provide a portable, boat-supported duck blind, which does not restrict a hunter from shooting in any direction.

In order to achieve these and other objects, the present invention comprises a collapsible duck blind for attachment to a boat, comprising a pair of front and rear hinged support legs, selectively movable between extended and retracted positions, each having a foot securable to the boat, preferably to the front and rear seats thereof. Secured to the upper end of the support legs is an upper frame, having at least one support structure selectively movable between raised and lowered positions. A cover is provided for covering the frame and support legs to conceal a hunter in the boat when the support structure is in its raised position. In the preferred embodiment, two support structures are included, one on each side of the boat. With the support structures in their raised positions, a hunter is substantially concealed for purposes of calling ducks. Upon lowering one support structure, the hunter is able to shoot towards that side of the boat, as well as the front and rear. Upon lowering the opposite support structure the hunter is able to shoot towards the other side of the boat. With both support structures lowered, the hunter is able to shoot in virtually any direction.

The above stated and other objects will become apparent to those skilled in the art upon reading the following detailed description, in conjunction with the appended drawing figures.

DETAILED DESCRIPTION OF THE PREFERRED EMBODIMENT

Figure 1:
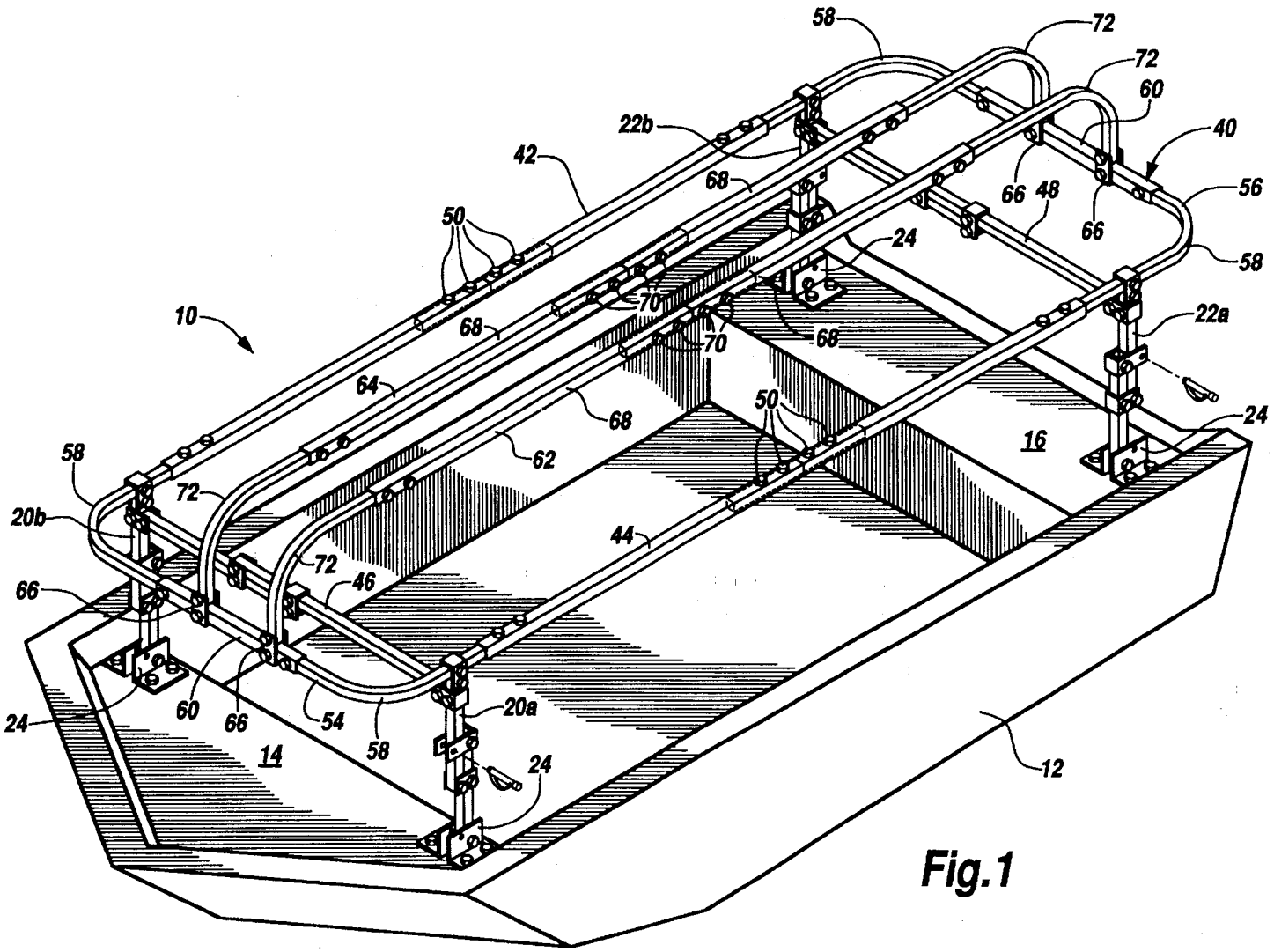
FIG. 1 is a top, side perspective view of a boat having the duck blind of the present invention secured thereon, with the cover removed to reveal the upper frame and support legs.
Figure 2:
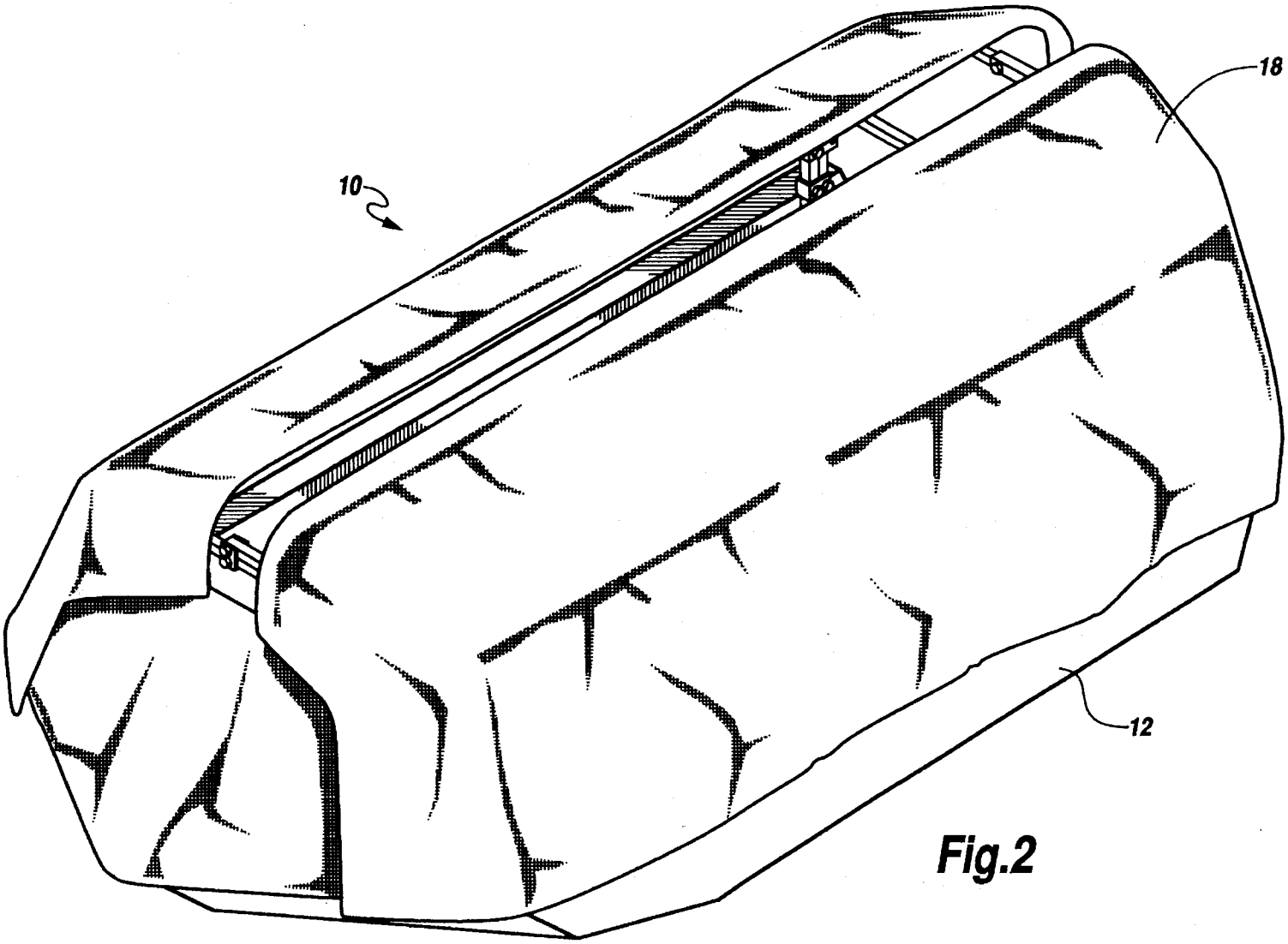
FIG. 2 is a top, side perspective view, similar to FIG. 1, with the cover installed.

Referring initially to FIGS. 1 and 2, duck blind 10 of the present invention is shown secured to a conventional boat 12, having a front seat 14 and a rear seat 16. As those familiar with boat-supported duck blinds will recognize, boat 12 is intended to depict a generic boat commonly used by duck hunters, and does not accurately depict any particular brand or style of boat. For purposes of this invention, the configuration of boat 12 is largely irrelevant, as duck blind 10 is designed to fit on almost any conventional boat, as explained more fully below. In FIG. 1, blind 10 is shown without cover 18, as seen in FIG. 2, for the sake of clarity. It will also be understood that cover 18 may be removed for purposes of storage, but will typically remain on blind 10 throughout an entire hunting season.

Figure 3:
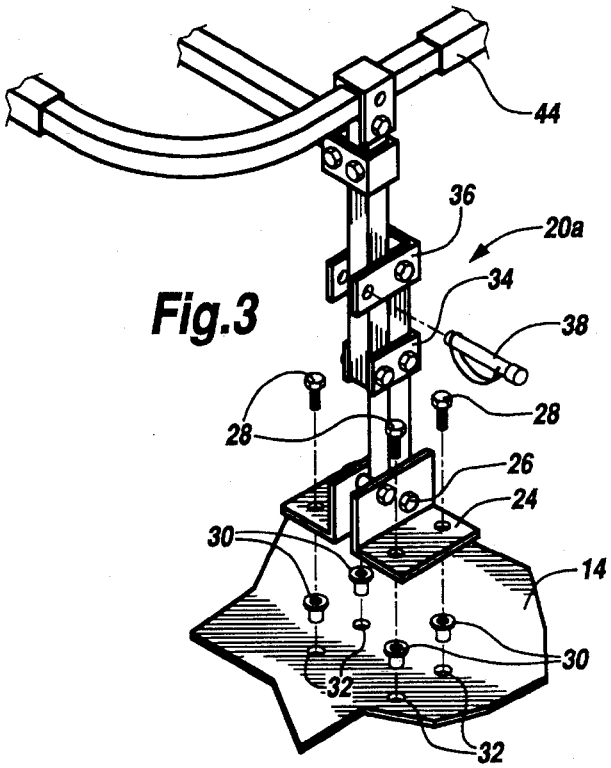
FIG. 3 is an enlarged perspective view showing the details of a representative support leg shown in its extended position.
Figure 4:
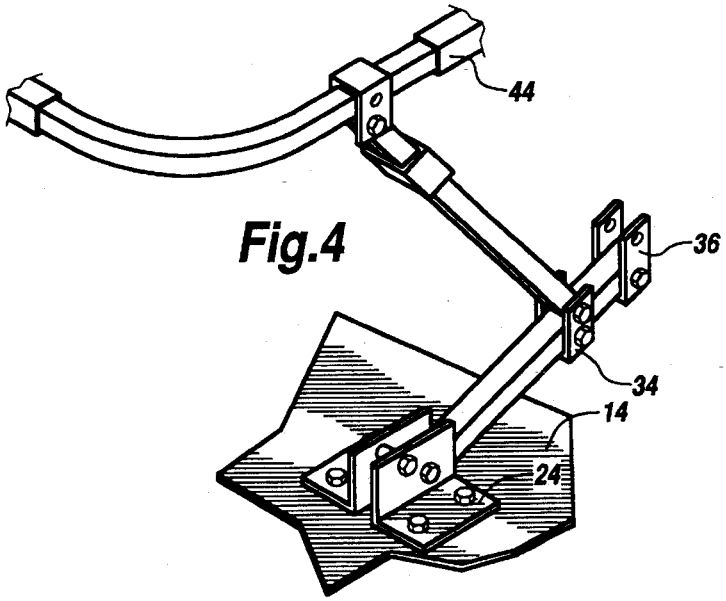
FIG. 4 is a perspective view of the support leg shown in FIG. 3, shown in a position intermediate its extended and retracted positions.
Figure 5:
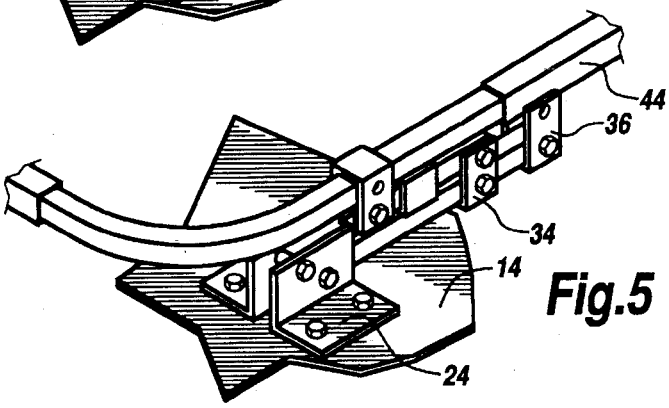
FIG. 5 is a perspective view of the leg shown in FIG. 3, shown in its retracted position.
Figure 6:
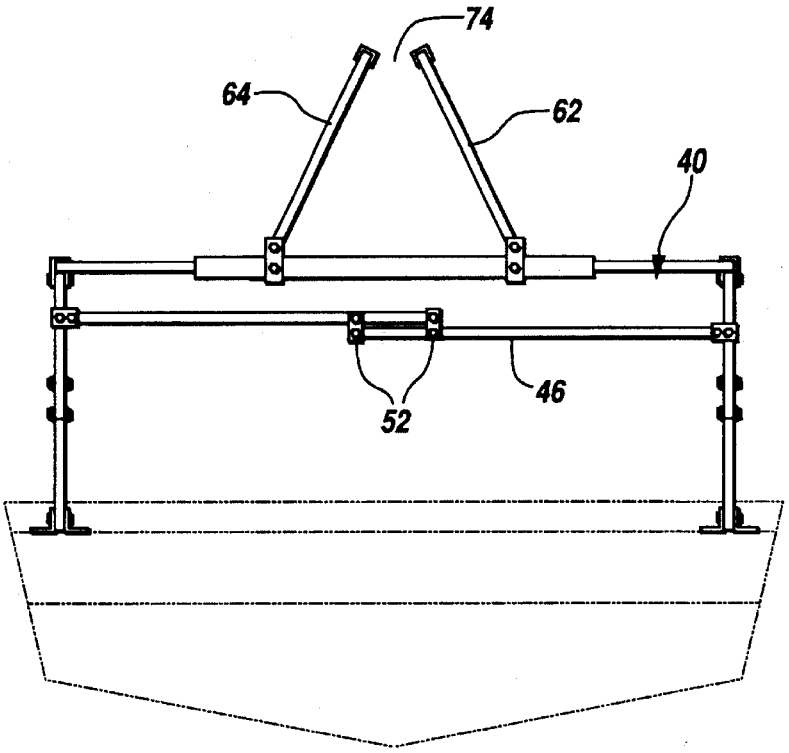
FIG. 6 is an end elevational view of the duck blind of the present invention, with the cover removed.

Referring still to FIG. 1, blind 10 includes four substantially identical support legs, a pair of front legs **20*a* and 20*b* and a pair of rear legs 22*a* and 22*b*. Each support leg has a foot at its lower end comprising a mounting bracket 24 adapted for attachment to seats 14 and 16. Referring now to FIGS. 3–5, a representative support leg 20***a* is shown in detail, it being understood that the structure of support legs 20*b*, 22*a* and 22*b* is essentially identical to that shown for leg 20*a*. Mounting bracket 24 is pivotally secured to the lower end of leg 20*a* by a bolt 26. Mounting bracket 24 is preferably secured to seat 14 (or seat 16 for legs 22*a* and 22*b*) by a plurality of screws 28 which threadingly engage blind fasteners 30 suitably engaged in holes 32 drilled in seat 14. In the preferred embodiment shown, blind fasteners 30 are of the type commonly referred to as the Rivnut, a product of the B. F. Goodrich Company. It is to be understood that any means of anchoring the foot of each support leg to a suitably rigid surface of boat 12 may be acceptable for purposes of this invention.

The upper and lower segments of support leg 20*a* are hingedly connected by a bracket 34, as best seen in FIGS. 3–5. With support leg 20*a* in its fully extended position shown in FIG. 3, a second bracket 36 is used in cooperation with a removable pin 38 to lock support leg 20*a* in position. When it is necessary or desirable to collapse duck blind 10 for transportation or storage, pins 38 are removed from each of legs 20*a*, 20*b*, 22*a*, and 22*b*, and the support legs folded to their retracted positions shown in FIG. 5.

Secured to the upper ends of the support legs is an upper frame 40, comprising a right side brace 42, a left side brace 44, a front lateral brace 46, and a rear lateral brace 48. In the preferred embodiment shown, each side brace 42 and 44 consists of two sections of square tubing, interconnected by a smaller section of tubing slidably disposed in their abutting ends. A plurality of bolts 50 are used to secure the two sections to the internal member. When constructed in this matter, side braces 42 and 44 may be adjusted upon initial attachment of blind 10 to boat 12, to ensure that the length of blind 10 is properly set. This construction also allows the length of blind 10 to be variable so that it can be installed on a variety of different sized boats. Similarly, front and rear braces 46 and 48 consist of two overlapping sections of square tubing, interconnected by a pair of brackets 52. Once the proper width for blind 10 has been established, the bolts used to secure brackets 52 are tightened to secure blind 10 in position. Those skilled in the art will appreciate the fact that blind 10 is, by virtue of the above described components, fully adjustable in both length and width to accommodate most common boats.

A pair of U-shaped braces 54 and 56 are secured within the front and rear open ends of side braces 42 and 44, respectively, as best seen in FIG. 1. Braces 54 and 56 preferably comprise three separate components, a pair of curved corner members 58 interconnected by a central square member 60, thereby making braces 54 and 56 adjustable to allow varying widths for blind 10. As shown, corner members 58 are preferably bolted to central member 60 once the preferred width for blind 10 has been established. A pair of upper support structures 62 and 64 are hingedly secured to members 60, at brackets 66. Each support structure 62 and 64 comprises a pair of outer square tubes 68 interconnected at their abutting ends by a smaller tube slidably disposed therein and a plurality of bolts 70. The opposite ends of each square tube 68 has a curved section 72 secured thereto, having its opposite end pivotally secured to bracket 66. It is to be understood that the construction of support structures 62 and 64 is substantially identical to that described above for side braces 42 and 44 and corner members 58, so that support structure 62 and 64 are similarly longitudinally adjustable to accommodate the length of boat 12.

Figure 7:
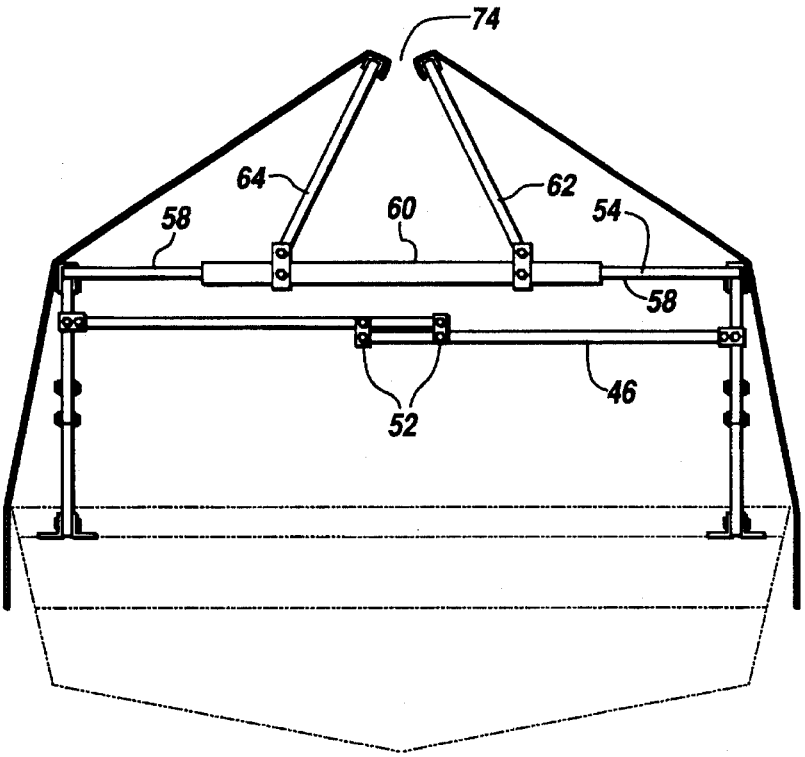
FIG. 7 is an end elevational view similar to FIG. 6, with the cover installed and shown in section.
Figure 8:
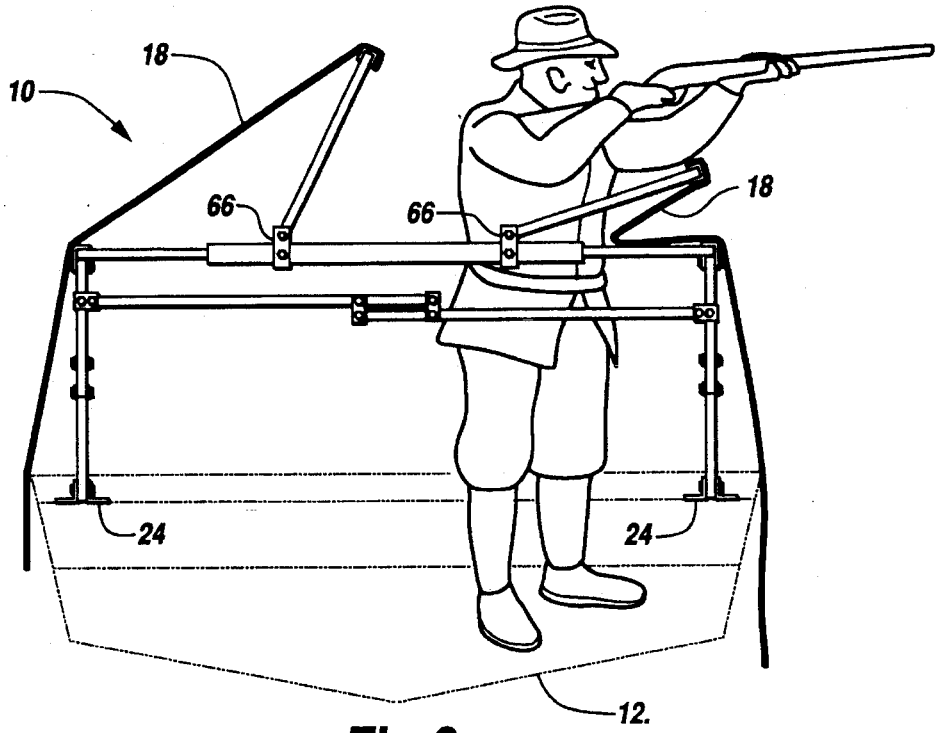
FIG. 8 is an end elevational view of the duck blind, with the cover shown in section, illustrating how one support structure of the frame may be lowered to allow a hunter to shoot from one side of the boat.
Figure 9:
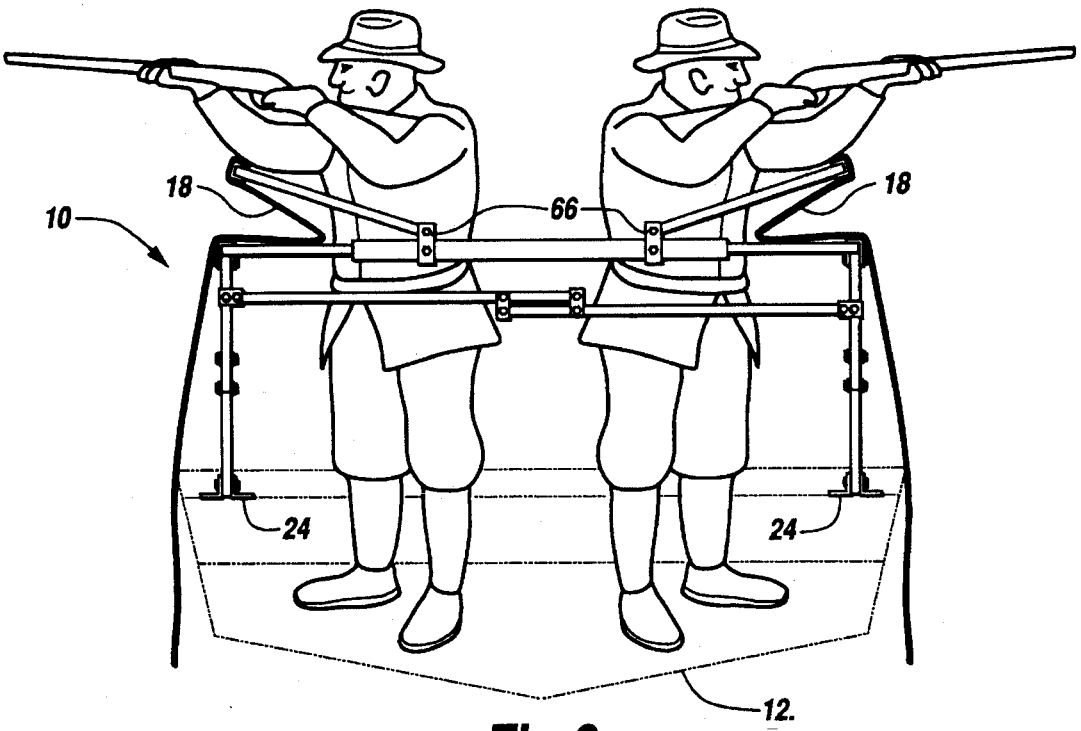
FIG. 9 is an end elevational view similar to FIG. 8, showing how both support structures may be lowered to allow shooting from either side, or both sides of the boat.

A unique aspect of blind 10 lies in the manner in which support structures 62 and 64 may be readily moved from their raised positions for calling water fowl to their lowered positions for shooting. When support structures 62 and 64 are in their raised positions, best seen in FIGS. 2 and 7, cover 18 substantially conceals the hunter or hunters within boat 10 while allowing the hunters to call ducks and observe their flight through the central gap 74. Once the ducks are within shooting range, the hunter can easily and quickly move either or both support structures 62 and/or 64 to their lowered positions for unobstructed shooting. As shown in FIGS. 8 and 9, a single hunter may shoot from either side of line 10, or a plurality of hunters may shoot from both sides simultaneously. Since the front and rear of blind 10 are likewise open, blind 10 allows a 360° field for shooting. The side sections of cover 18 are affixed to support structures 62 and 64 by conventional means such as Velcro, snaps, zippers, etc., and move up and down therewith.

Another unique advantage provided by blind 10 is the simplicity with which it may be raised for hunting and collapsed for transportation and storage. As described above, each of the support legs 20 and 22 is hinged. It will also be apparent to those skilled in the art that it may be necessary to remove the bolts from either the front or rear ends of braces 42 and 44 and the straight sections of support structures 62 and 64 so that the curved members 58 and 72 are allowed to slide therein when raising and lowering blind 10. The user may prefer to omit the bolts from one end or the other altogether, or may simply choose to remove them when blind 10 is to be lowered for transportation or storage, and re-install the bolts when blind 10 is raised for use.

While the principles of the preferred embodiment have been clearly disclosed in the foregoing detailed description, it is to be understood that numerous modifications may be made to the embodiment disclosed herein without departing from the spirit and scope of this invention. Accordingly, the scope of this invention is to be limited only by the following claims and prior art.

What is claimed is:

1. A collapsible duck blind for attachment to a boat, said boat being occupied by at least one hunter during normal usage thereof, comprising:

left and right front support legs selectively movable between extended and retracted positions, each having a foot portion securable to said boat and an upper end spaced therefrom;

left and right rear support legs selectively movable between extended and retracted positions, longitudinally spaced from said front support legs, each having a foot portion securable to said boat and an upper end spaced therefrom;

an upper frame mounted to said upper ends of said front and rear support legs, said frame having at least one support structure selectively movable between raised and lowered positions, said duck blind being positionable in a collapsed condition upon moving said support legs to said retracted positions and said at least one support structure to said lowered position, and positionable in a raised condition upon moving said support legs to said extended positions: and cover means for substantially covering said frame and said support legs, operative to substantially conceal a hunter in said boat when said at least one support structure is in said raised position.

2. A duck blind as set forth in claim 1, wherein:

each of said support legs is hinged.

3. A duck blind as set forth in claim 1, wherein:

each of said support legs further includes locking means for selectively locking said support legs in said extended position to prevent inadvertent collapsing of said duck blind.

4. A duck blind as set forth in claim 1, wherein:

a portion of said cover means is movable with said at least one support structure, and is selectively movable between call and shoot positions corresponding to said raised and lowered positions of said support structure, respectively, said shoot position resulting in said portion of said cover being lowered to enable said hunter to shoot in at least a partially horizontal direction from said boat.

5. A duck blind as set forth in claim 4, wherein:

said upper frame includes two said support structures disposed on laterally opposite sides thereof, each having a movable portion of said cover means associated therewith, whereby a hunter is allowed to shoot from either side of said boat.

6. A duck blind as set forth in claim 1, wherein said upper frame further comprises:

a front lateral brace member interconnecting said front support legs;

a rear lateral brace member interconnecting said rear support legs;

a right side longitudinal brace member interconnecting said right front support leg and said right rear support leg; and a left side longitudinal brace member interconnecting said left front support leg and said left rear support leg.

7. A duck blind as set forth in claim 6, wherein:

said brace members are attached to said upper ends of said support legs.

8. A duck blind as set forth in claim 6, wherein:

each of said brace members is longitudinally adjustable, thereby enabling adjustment of both the width and the length of said duck blind.

9. A portable blind mountable to a boat for use by a hunter, comprising:

front support means selectively movable between extended and retracted positions, having a foot portion securable to said boat and an upper end spaced therefrom;

rear support means selectively movable between extended and retracted positions, longitudinally spaced from said front support legs, having a foot portion securable to said boat and an upper end spaced therefrom;

an upper frame mounted to said upper ends of said front and rear support means, said frame having first and second support structures selectively movable between raised and lowered positions, said blind being positionable in a collapsed condition upon moving said support means to said retracted positions and said first and second support structures to said lowered positions, and positionable in a raised condition upon moving said support means to said extended positions; and cover means for substantially covering said frame and said support means, operative to substantially conceal a hunter in said boat when said support structures are in said raised positions.

10. A portable blind as set forth in claim 9, wherein:

said upper frame comprises a pair of side braces and front and rear lateral braces, all of which are longitudinally adjustable.

11. A portable blind as set forth in claim 10, wherein:

said upper frame further comprises front and rear U-shaped braces, said support structures being hingedly secured thereto, said U-shaped braces and said support structures being longitudinally adjustable.

12. A portable blind as set forth in claim 9, wherein:

said cover means is removably fastened to said upper frame.

* * * * *